US005279506A

United States Patent [19]

Kawase et al.

[11] Patent Number: 5,279,506

[45] Date of Patent: Jan. 18, 1994

[54] CONNECTOR

[75] Inventors: Hajime Kawase; Kaoru Watanabe, both of Yokkaichi, Japan

[73] Assignee: Sumitomo Wiring Systems, Ltd., Mie, Japan

[21] Appl. No.: 964,442

[22] Filed: Oct. 21, 1992

[30] Foreign Application Priority Data

Oct. 21, 1991 [JP] Japan ..... 3-272524

[51] Int. Cl.[5] ..... H01R 13/00

[52] U.S. Cl. ..... 439/157

[58] Field of Search ..... 439/152-160

[56] References Cited

U.S. PATENT DOCUMENTS

| | | | |
|---|---|---|---|
| 2,987,693 | 6/1961 | Wamsley | 439/157 |
| 3,059,206 | 10/1962 | Williams | 439/157 |
| 3,575,685 | 4/1971 | Gley | 439/157 |
| 3,836,938 | 9/1974 | Barrett, Jr. et al. | 439/157 |
| 5,035,634 | 7/1991 | Hasircoglu et al. | 439/157 |
| 5,152,697 | 10/1992 | Abe et al. | 439/152 |

FOREIGN PATENT DOCUMENTS 363804 4/1990 European Pat. Off. .

676799 8/1952 United Kingdom .

*Primary Examiner*—Joseph H. McGlynn

*Attorney, Agent, or Firm*—Sughrue, Mion, Zinn, Macpeak & Seas

[57] ABSTRACT

A connector with a lever for reducing the force required for connection between the first and second interlocking connectors. The second connector includes a freely-pivoting lever with a pair of connector guide holes. The first connector includes a pair of guide pins. A connector box secured at any given location includes a connector cavity, with an opening on the mating member side, for the first and second connectors. Guide rails are provided in the connector box housing for guiding the first and second connectors. A lever guide is further provided in the housing for guiding the lever according to the movement of second connector. When the first connector member is pressed against the second connector member housed in the housing, the guide holes engage with the guide pins and the force pulls the first connector member to the second connector member according to the moving position of thereof.

4 Claims, 5 Drawing Sheets

CONNECTOR

BACKGROUND OF THE INVENTION

1. Field of the Invention

The present invention relates to a connector with a lever for connecting mating male-female units with a single action simply and, more particularly, to a connector well suited for an automotive wire harness connection.

2. Description of the Prior Art

A variety of lever type connectors, with levers for reducing the force required for a male-female connection between mating connector units, are commonly used today. One such connector is shown in FIG. 8.

This connector includes a mating plug unit 2 for accommodating a plurality of first electrical wires with first terminals (not shown) therein and a receptacle unit 1 for accommodating a plurality of second electrical wires with second terminals (not shown) therein. The first and second electrical wires are electrically connected by engaging the first and second terminals thereof when the plug unit 2 is inserted into the receptacle unit 1.

The receptacle unit 1 is provided with an receptacle space 1*a* formed on one side surface, exposing the accommodated first terminals therein. The receptacle unit 1 further has lever 3 installed on the side surface of the receptacle opening 1*a* in a freely pivoting manner, as shown in FIG. 8. The lever 3 has an guide holes 3*a* in a curved line. The lever 3 further has a guide hole leader 3*b* engraved on the inner side thereof, facing the first connector 1, between the guide hole 3*a* and one side edge of the lever 3.

When the plug unit 2 and receptacle unit 1 are engaged with each other, the plug portion 2*a* is inserted into the receptacle opening 1*a* as the guide pins 4 are guided into the guide holes 3*a* by the guide hole leaders 3*b*. Then, the lever 3 is rotated in the direction of the arrow A, the guide pins 4 are pulled in the direction B by the guide holes 3. Thus, the plug unit 2 is forced to further insert into the receptacle opening 1*a*, and the first and second terminals accommodated in two units 1 and 2 are connected. The manual force required to connect the units 1 and 2 at this time is less than that required to connect them directly by hand because the basic lever and fulcrum principle applied with the lever 3 reduces the required force.

When connecting this conventional lever type connector, however, the receptacle unit 1 and plug unit 2 must be held by hand and positioned so that the guide pins 4 are located in the guide hole leaders 3*b* at the end of the guide hole 3*a* in the initial position shown in FIG. 8, after which time the lever 3 is operated.

In other words, connecting the conventional lever type connector requires an awkward two step operation: positioning the receptacle unit 1 and plug unit 2 in the initial position, and then operating the lever 3 to complete the connection. In addition, the need to hold both two units 1 and 2 by hand increases the difficulty of this operation.

SUMMARY OF THE INVENTION

The object of the present invention is therefore to provide a lever type connector which solves these problems.

The present invention has been developed with a view to substantially solving the above described disadvantages and has for its essential object to provide an improved connector.

In order to achieve the aforementioned objective, a lever type connector which is used to connect one pair of first and second terminals comprises a first connector member for accommodating the first terminal therein and provided with a first engaging means, a second engaging means, and a first guide means; a second connector member for accommodating the second terminal therein and provided with a third engaging means engageable to the first engaging means, a second guide means and a lever means pivotally provided thereon, the lever means provided with a fourth engaging means engageable to the second engaging means; and a housing means for accommodating the first and second connector members and provided with an opening at one end surface thereof. The housing means comprises a guide means engageable with the first and second guide means for guiding the first and second connector members in a direction perpendicular to the end surface; and a fifth engaging means engageable to the lever means such that the lever means can rotate according to the position of the second connector member housed in the housing means, whereby when connector means is pressed through the first opening against the second connector member, the fourth engaging means engages with the second engaging means to force the first and third engaging means in a firmly engaged state.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

Figure 1:
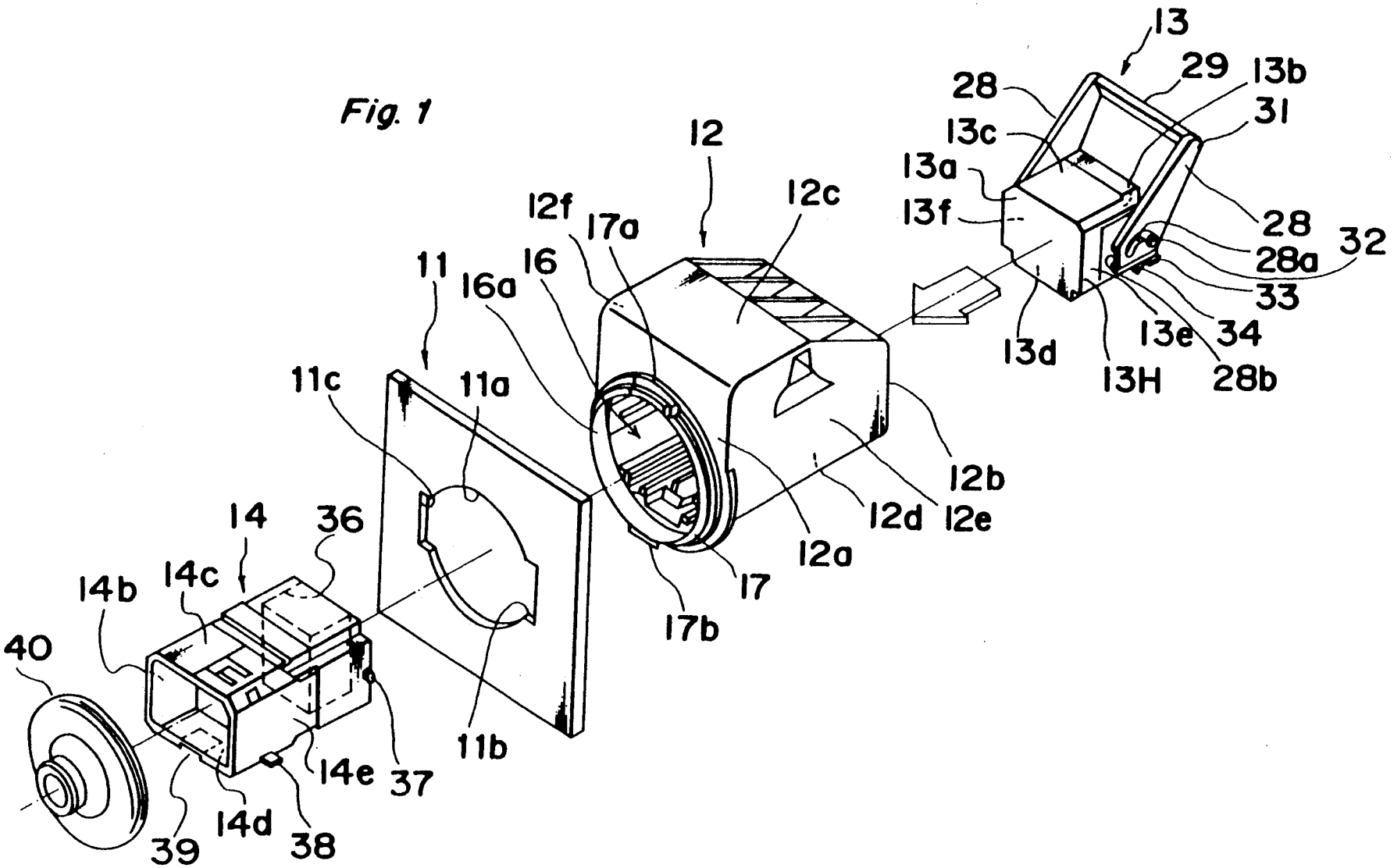
FIG. 1 is an exploded perspective view of a connector according to an preferred embodiment of the present invention.

Referring to FIG. 1, a preferred embodiment of a lever type connector is shown. The lever type connector is for reducing the force required to connect the male and female connector units.

The connector includes a connector box 12, a plug connector unit 13 inserted in the connector box 12, and a receptacle connector unit 14 that engages the plug connector unit 13 inside the connector box 12. The connector according to the present inventon is installed, e.g., in an automobile, and is supported on a panel 21 having a round hole 11*a* with a pair of notches 11*b* and 11*c*. A grommet 40 is a cap member for closing an opening 16*a*.

The connector box 12 is in a rectangular parallelepiped configuration defined by first and second end surfaces 12*a* and 12*b* and four side walls 12*c*, 12*d*, 12*e*, and 12*f*, extending therebetween. The top and bottom side walls 12*c* and 12*d* are opposed to each other, and the right and left side walls 12*e* and 12*f* are also opposed to each other. The connector box 12 has a connector cavity 16 formed therein for accommodating the connector units 13 and 14 therein. The connector cavity 16 has a first opening 16*a* in the first end surface 12*a*, and a second opening 16*b* in the second end surfaces 12*b* (shown in FIGS. 2 to 5).

Around the first opening 16*a*, a mounting ring 17 is formed and is integrally connected with the first end surface 12*a*. The mounting ring 17 has a pair of engaging members 17*a* and 17*b* provide in the peripheral side surface of the mounting ring 17, in shapes and positions corresponding to the those of notches 11*b* and 11*b*.

The connector box 12 is secured to the panel 11 by inserting the engaging members 17*a* and 17*b* through the notches 11*b* and 11*c* in the round hole 11*a*, such that the panel 11 is sandwiched securedly between the engaging members 17*a* and 17*b*, and the first end surfaces 12*a* of the connector box 12.

The plug connector unit 13 has a plug housing 13H, configured in a generally cubic shape defined by first and second end surfaces 13*a* and 13*b* and four side walls 13*c*, 13*d*, 13*e*, and 13*f*, extending between the first and second end surfaces 13*a* and 13*b*. The plug housing 13H is provided with a plural terminal housings (not shown) for accommodating female terminals on the first end surface 13*a*. Thus, the first end surface 13*a* portion serves as a plug portion for the connection with the connector unit 14 on the other side. The plug connector unit 13 has a pair of pivot pins 32 provided on the side walls 13*c* and 13*d*, proximal to the second end surface 13*b*.

The plug connector unit 13 further has a lever 31 pivotally provided on the plug housing 13H with respect to the pivot pins 32. On the bottom side edges of side surfaces 13*e* and 13*f*, a pair of first engaging members 33 are provided in positions proximal to the second end surface 13*b*. The first engaging member 33 is in a rectangular plate-like shape, projecting outwardly. Furthermore, on the side edges of bottom wall 13*d*, a pair of second engaging members 34 are provided in positions proximal to the first engaging members 33. The second engaging member 34 is in a triangle-like shape, projecting downwardly.

The lever 31 is in a generally U-shaped configuration, defined by a center portion 29 and two arm portions 28 attached to the opposite ends of the center portions 29. The arm portion 28 is formed in an oblique triangle shape, and is, at the first stage, inclined to leftward, when viewed in FIG. 2. At the end portion of each arm portion 28 remote from the center portion 29, a guide groove 28*a* is formed by a predetermined depth in the opposite side surfaces thereof. Each arm portion 28 further has a guide channel hole 28*b* configured in a reversed U-shape, integrally connected the guide groove 28*b*. The guide groove 28*a* and guide channel hole 28*a* integrally connected. The lever 31 is installed on the plug unit 13 in such a manner that pivot pins 32 are captured in the far ends of the guide channel holes 28*a*, away from the guide grooves 28*b*.

The receptacle connector unit 14 has a rectangular box-like configuration defined by first and second surfaces and four peripheral side walls 14*c*, 14*d*, 14*e*, and 14*f*, having a receptacle space 36 opened at the first surface thereof. The receptacle space 36 is wide and deep enough to accommodate the plug portion 13*a* of the plug connector unit 13 therein. The receptacle unit 14 is provided with a plural terminal housings (not shown) for holding male terminals on the receptacle space 36 side. The receptacle space 36 is shown on the right side of the receptacle connector unit 14 in FIG. 1.

The receptacle connector unit 14 further has a pair of guide pins 37 provided on the opposite peripheral side walls 14*e* and 14*f*, proximal to the end surface of the receptacle space 36, at about middle position thereof. On the bottom side edges of side walls 14*e* and 14*f*, a pair of third engaging members 38 are provided at positions remote from the receptacle space 36. The third engaging member 38 is in a rectangular plate like shape, projecting outwardly in a direction perpendicular to the side surfaces 14*e* and 14*f*. The receptacle connector unit 14 is further provided with fourth engaging members 39 in the center of side edges of the bottom side wall 14*d*, remote from the receptacle space 36. The fourth engaging member 39 is formed in a shape engageable a tapered tip 29*a*, as will be described in detail later.

Figure 2:
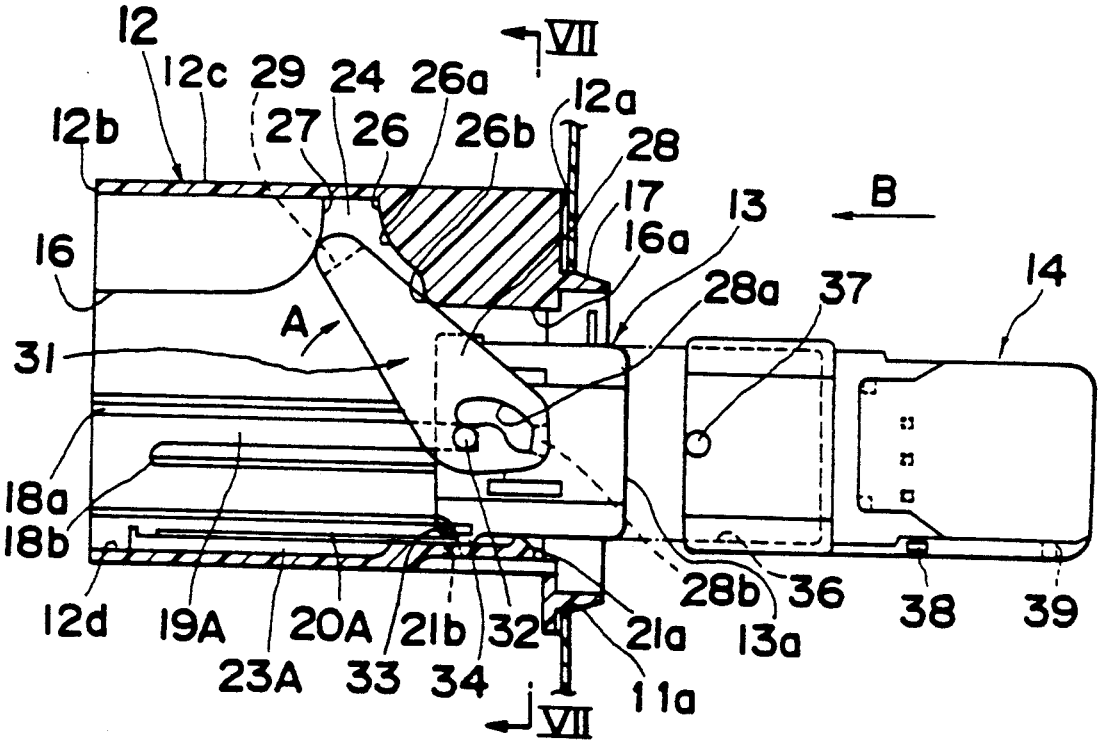
FIGS. 2, 3, 4, and 5 are cross sectional views for assistance in explaining the connecting operation of the connector shown in FIG. 1

Referring to FIG. 2, a cross sectional view of the connector box 12 secured to the panel 11 and the plug connector unit 13 placed in the connector cavity 16 is shown. FIG. 2 shows the internals of the connector box 12. It is to be noted that the inner surface of the side walls 12*e* and 12*f* are formed in symmetrical shapes to each other. Therefore, the detailed descriptions and illustration of construction on the side wall 12*f* is omitted for the sake of brevity.

Inside the connector cavity 16, a pair of first elongated ridges 18*a* are provided approximately at a middle of the opposite side walls 12*e* and 12*f* of the connector box 12, such that each first elongated ridge 18*a* extends in a direction approximately perpendicular to the first and second end surfaces 12*a* and 12*b*. Under the first elongated ridges 18*a*, another pair of second elongated ridges 18*b* are provided, extending parallel to the first elongated ridges 18*a* and keeping a predetermined distance therebetween. The ridges 18*a* and 18*b* form a pair of slide channels 19A and 19B therebetween on the sides 12*e* and 12*f*, such that the pivot pins 32 of the plug connector unit 13 can be inserted to and slide along these slide channels 19A and 19B.

Figure 7:
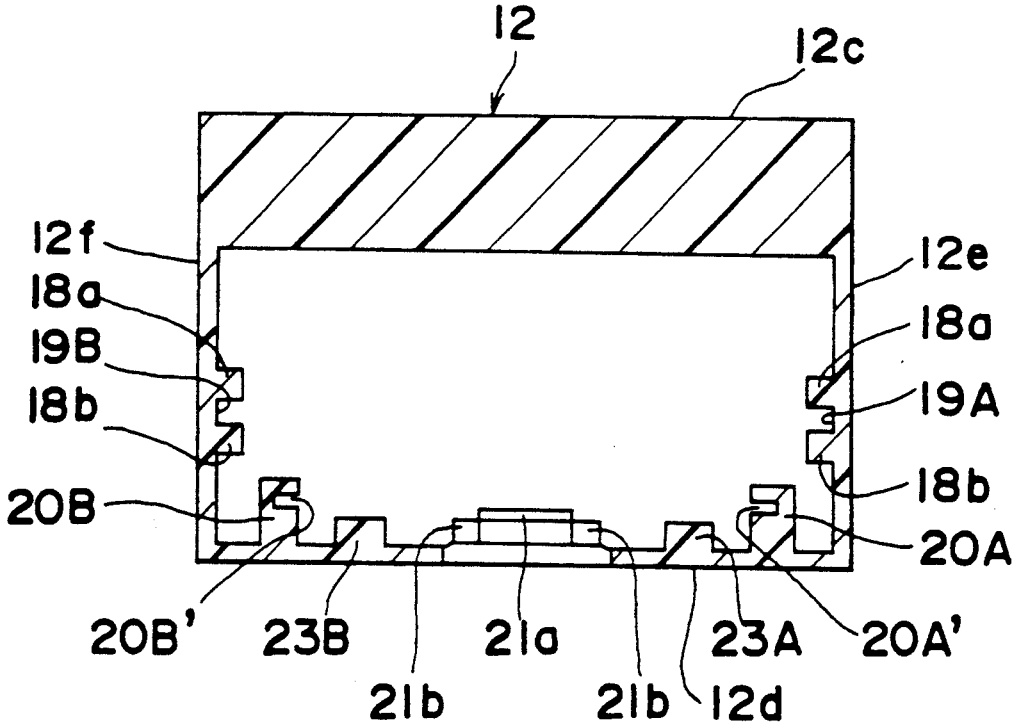
FIG. 7 is a cross sectional view of the connector box 12 taken along a line VII—VII shown in FIG. 2
Figure 8:
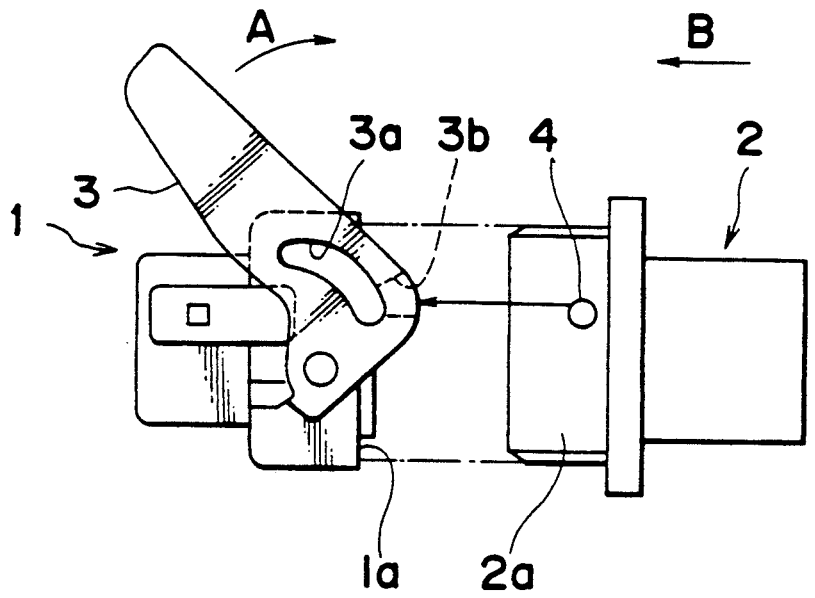
Fig. 8 PRIOR ART
FIG. 8 is a schematic side view of a conventional lever type connector.

As best shown in FIG. 7 which is a cross sectional view of the connector box 12 at a portion near the first end surface 12*a*, on the bottom wall 12*d*, a pair of elongated rails 20A and 20B are provided. The rails 20A and 20B have a generally C-shaped configuration in the cross section, forming elongated channels 20A' and 20B' for receiving the first engaging members 33 of the plug connector unit 13. These rails 20A and 20B are located with elongated channels oppose to each other such that the first engaging members 33 can engage with the channels 20A' and 20B' when the plug connector unit 13 is inserted into the connector cavity 16. Thus, the plug connector unit 13 can slide freely inside the connector cavity 16 along the rails 20A and 20E.

Figure 6:
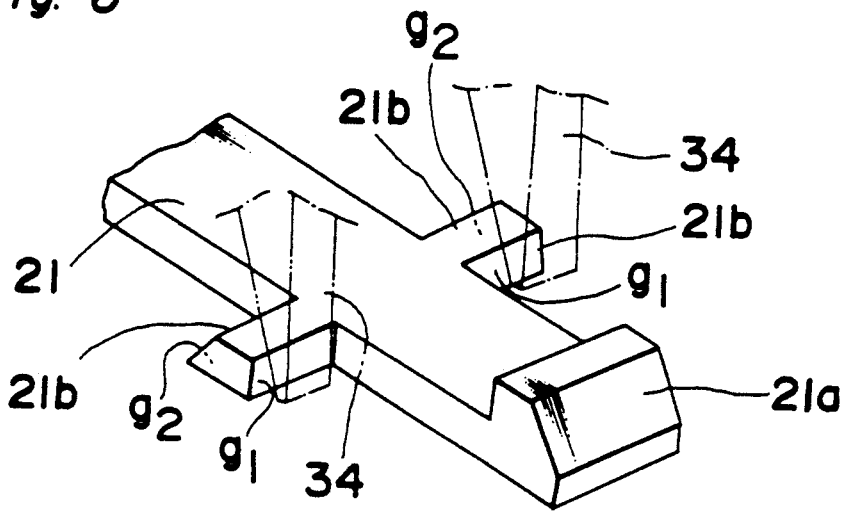
FIG. 6 is a perspective view of a lance portion of the connector shown in FIG. 1.

A lance means 21 is formed by the bottom side wall 12*d*, facing the first end surface 12*a*, and at an approximately center portion between side walls 12*e* and 12*f*. As best shown in FIG. 6, the lance means 21 is in a generally flat plate like configuration having a free end portions and a fixed end portions integrally connected to the bottom side 12*d*. By the fixed end portions, the lance means 21 is raised up a predetermined length above the bottom side wall 12*d* and extends in a direction perpendicular to the first end surface 12*a*. The lance means 21 has an tapered tip 21*a* at the free end and a pair of projections 21b perpendicularly extending from the middle side positions thereof.

The tapered top 21a has a generally right trapezoidal shape, in the cross section, defined by two opposite sides, an upright side with respect to two parallel opposite sides, and an inclined side, and is located on the lance means 21 such that the inclined side is directed to the second opening 12b.

The projection 21b has a generally trapezoidal shape, in cross section, defined by two parallel sides and first and second inclined sides g1 and g2. The first inclined side g1 faces the arrowhead-shaped tip 21a and inclined by a predetermined angle toward the second opening 16b. The second inclined side g2 is located at the opposite side to the first inclined side g1 and is inclined at a predetermined angle toward the first opening 16a.

The lance means 21 is less wide then the bottom width of the plug connector unit 13. The projections 21b project from the lance means 21 sides by a predetermined length enough to receive the second engaging members 34 when the plug connector unit 13 is placed on the lance means 21.

Referring back to FIG. 2, inside the connector cavity 16, a lever positioning means 24 is formed on the top side wall 12c for receiving and positioning the end portion 29 of lever 31. The lever positioning means 24 is formed by opposing first and second convex surfaces 26 and 27, extending proximal and parallel to the first and second side surfaces 12a and 12b, respectively. The first and second convex surfaces 26 and 27 are separated from each other by a predetermined length, forming a cavity 24 defined by the side walls 12d, 12e, and 12f, and convex surfaces 26 and 27.

The first convex surface 26, provided on the first end 12a side of the connector box 12, comprises a large convex surface 26a with a relatively large radius of curvature, and a small convex surface 26b with a relatively small radius of curvature. The large convex surface 26a is above the small convex surface 25b when viewed in FIG. 2.

The second convex surface 27 is a single continuous curve through which the radius of curvature gradually increases from the top to the bottom of the curve, as shown in FIG. 2.

The first and second curved surfaces 26, 27 of the lever positioning means 24 form the lever guide means. The lever guide means functions to guide the end of the lever 31 so that the lever 31 rotates in the direction of the arrow A in conjunction with the movement of the plug connector unit 13 to pull the receptacle connector 14 onto the plug connector unit 13 when the receptacle space 36 of the receptacle connector unit 14 is pressed over the mating member 13a of the first connector 13 when connecting the two connector units 13 and 14, as described below.

The plug connector unit 13 is accommodated in thus constructed connector cavity 16 of the connector box 12, such that the first and second side surfaces 13a and 13b of the plug connector unit 13 face the first and second end sides 12a and 12b, respectively. The plug connector unit 13 is placed in the connector cavity 16 proximally to the first opening 16a with the lever 31 turned toward the second opening 16b and captured in the lever positioning means 24.

At this time, the projections 21b of the lance means 21 engage with the second engaging members 34 of the plug connector unit 13, such that the second engaging member 34 rides on the inclined side g1 of the projection 21, as shown in FIG. 6.

The pivot pins 32 are captured in the slide channels 19A and 19B, and first engaging members 33 are captured in the side channels of rails 20A and 20B, so that the plug connector unit 13 can be moved freely along those channels in and out of the connector cavity 16.

Since the plug connector unit 13 is housed in a connector box 12 secured to an independent panel 11, it is not necessary to hold the plug connector unit 13 when connecting the receptacle connector unit 14.

Figure 3:
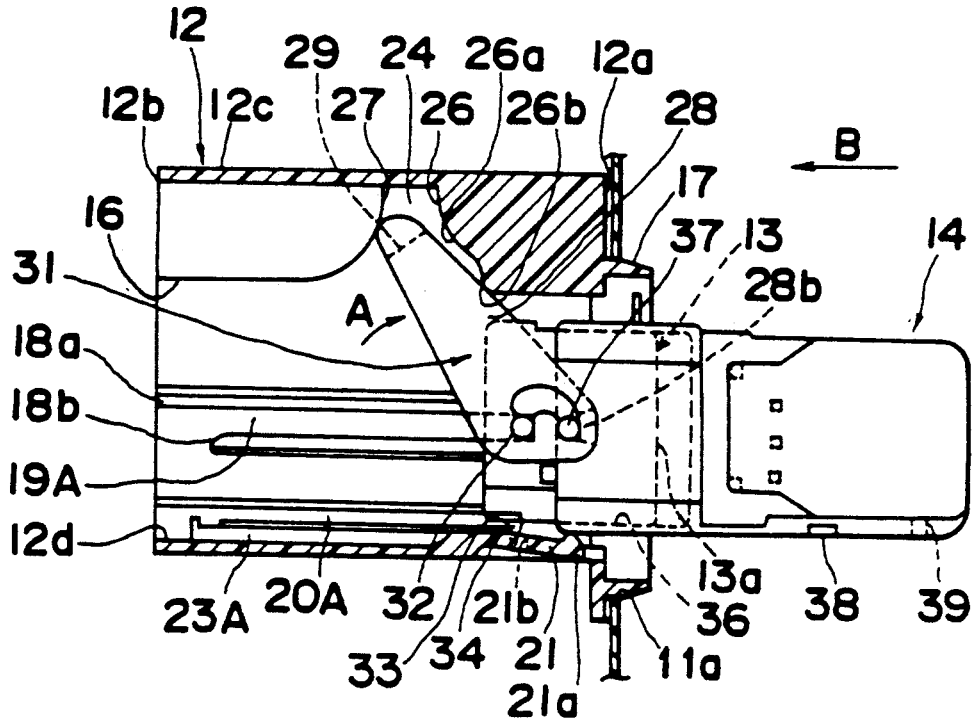
Figure 4:
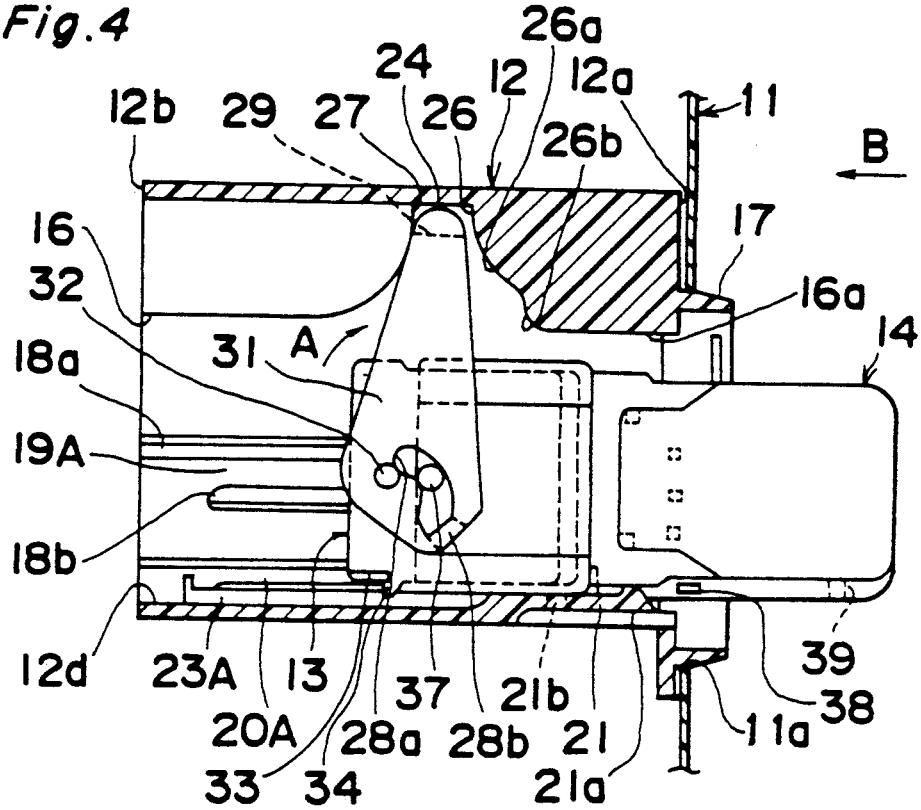
Figure 5:
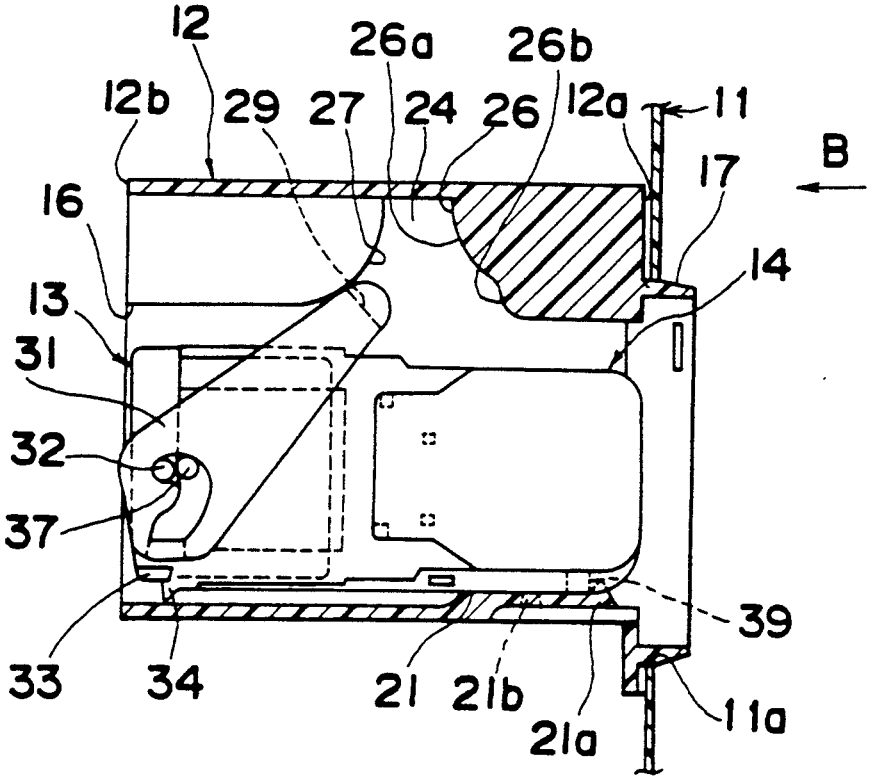

Referring to FIGS. 3, 4, and 5, the method for connecting the plug connector unit 13, thus housed in the housing 16, with the receptacle connector unit 14 is described herebelow.

When the receptacle connector unit 14 is pressed over the mating portion 13a of the plug connector unit 13 in the direction of arrow B, the guide pins 37 are guided into the guide channel holes 28a by the guide grooves 28b. Since the guide channel hole 28a is in a reversed U shape, the guide pins 37 strike the convex edge of the guide channel hole 20a, as best shown in FIG. 3.

By a further pressing of the receptacle connector unit 14, the guide pins 37 are pressed against the guide channel hole edge, so that the plug connector unit 13 is forced to move into the connector cavity 16 in the arrow direction B (to the left in the figure; hereinafter all specified directions are relative to the figures). Then, the second engaging members 34, riding on the projections 21b at the first inclined side g1, presses the projections 21b downwardly along the inclined side surfaces. As a result of this, the lance means 9 is bent down, causing the arrowhead-shaped tip 21 to move down to a position lower than the bottom edge of the receptacle connector unit 14.

As shown in FIG. 3, by further pressing the receptacle connector unit 14, the second engaging members 34 move over the projections 21b and ride on the second inclined sides g2 thereof, while the receptacle connector unit 14 further enters the housing 16, in contact with the arrowhead-shaped tip 21a.

As shown in FIG. 4, when the receptacle connector unit 14 is pressed farther onto the plug connector unit 13, the receptacle space 36 surrounds the plug portion 13a. Furthermore, as the receptacle connector unit 14 moves to the left, the lever end portion 29 is guided by the second convex surface 27 of the lever positioning means 24, and the lever 31 rotates clockwise as shown by the arrow A. Because the guide pins 37 are captured in the connector guide hole 28a of the lever 31, the first and second connectors 13, 14 are pulled together by the action of the lever 31 as they are both forced to the left. The receptacle connector unit 14 moves smoothly and dependently to the left together with the plug connector unit 13, while the third engaging members 38 thereof are guided by the rails 20A and 20B.

As best shown in FIG. 5, when the receptacle connector unit 14 is pressed farther onto the connector cavity 16, the receptacle connector unit 14 is fit completely around the plug connector unit 13 by the rotation of the lever 31, and the terminals in the connector units 13 and 14 are connected. The arrowhead-shaped tip 21 of a lance means 21 engages with the fourth engaging member 39 on the bottom of the receptacle connector unit 14 to hold the connection.

Thus, the signals action of pressing the receptacle connector unit 14 onto the plug connector unit 13 housed in the connector box 12 according to the present invention completes the connection.

The present invention shall not be limited to the embodiment described above, and can be varied in many ways. For example, the connector box in this embodiment is described as being secured to a panel in an automobile, but the connector box can be similarly secured in any other location. It is also possible to construct such that a plug connector unit is pressed against a mating portion of a receptacle connector unit, with lever pivotally mounted thereon, which is housed in the connector box.

Furthermore, the guide means shall not be limited to the channel guides and rails described above, but may be of any other construction similarly guiding the plug connector unit in a straight line inside the connector cavity.

As described hereinabove, a connector according to the present invention houses a plug connector unit in a connector box secured to a desired location. The plug connector unit is guided in a straight line in the connector box by a guide means, and the lever mounted on the plug connector unit is positioned in a lever positioning member which also functions as a lever guide means. Thus, by simply pressing the receptacle connector unit onto the plug portion of the plug connector unit, the lever rotates and pulls the plug and receptacle connector units together, thus completing the connection between the plug and receptacle connector units.

In other words, it is possible to complete and greatly simplify the connection between the terminals of the plug and receptacle connectors with the single-action operation of pressing the receptacle connector unit onto the mating portion of the plug connector unit.

Furthermore, the operability of the connection is also improved because the plug connector unit is housed in a connector box secured at a given location, and it is therefore only necessary to hold the receptacle connector unit when making the connection.

Furthermore, when a first positioning means that holds the plug connector unit temporarily with the mating member thereof at the opening of the connector cavity, and a second positioning means that holds the connected plug and receptacle connector units at the other side of the connector cavity are provided, the position of the plug connector unit before and the position of the plug and receptacle connector units after connection is completed can be reliably maintained at a predetermined position.

In addition, because the guide pins of the receptacle connector unit are inserted to the connector guide holes in the lever, and the lever and fulcrum principle is applied by rotating the lever to pull the plug and receptacle connector units together, the present invention provides the additional benefit of reducing the force required to complete the connection.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A lever type connector which is used to connect one pair of first and second terminals, comprising:

a first connector member for accommodating said first terminal therein and provided with a first engaging means, a second engaging means, and a first guide means;

a second connector member for accommodating said second terminal therein and provided with a third engaging means engageable with said first engaging means, a second guide means and a lever means pivotally provided thereon, said lever means provided with a fourth engaging means engageable with said second engaging means; and a stationary connecting box fixedly secured at a predetermined location and for accommodating said first and second connector members and provided with an opening at one end surface thereof, said stationary connecting box comprising:

a guide means engageable with said first and second guide means for guiding said first and second connector members in a direction perpendicular to said one end surface; and a fifth engaging means engageable with said lever means such that said lever means can rotate according to the position of said second connector member housed in said stationary connecting box, whereby when said first connector member is pressed through said opening against said second connector member, said fourth engaging means engages with said second engaging means to force said first and third engaging means into a firmly engaged state.

2. A connector as claimed in claim 1, wherein said stationary connecting box further comprises a fixing means for securing said stationary connecting box at a given location on a support panel.

3. A connector as claimed in claim 1, further comprising:

a first positioning means provided on said second connector member and a second positioning means provided in said stationary connecting box for engaging with said first positioning means and securing said second connector member thereon temporarily.

4. A connector as claimed in claim 3, further comprising:

a third positioning means provided in said first connector member and a fourth positioning means provided in said stationary connecting box for engaging with said third positioning means and for securing said first connector member temporarily.

* * * * *